United States Patent [19]

Patsch et al.

[11] 4,212,709

[45] Jul. 15, 1980

[54] ACIDIC NICKEL ELECTROPLATING BATH CONTAINING SULFOBETAINES AS BRIGHTENERS AND LEVELLING AGENTS

[75] Inventors: Manfred Patsch, Wachenheim; Dieter Schneider, Ludwigshafen; Guenther Gotsmann, Frankenthal; Albert Hettche, Hessheim, all of Fed. Rep. of Germany

[73] Assignee: BASF Aktiengesellschaft, Fed. Rep. of Germany

[21] Appl. No.: 38,171

[22] Filed: May 11, 1979

[30] Foreign Application Priority Data

Jun. 14, 1978 [DE] Fed. Rep. of Germany ..... 2825966

[51] Int. Cl.[2] ..... C25D 3/18

[52] U.S. Cl. ..... 204/49; 544/224; 544/242; 544/358; 546/122; 546/182; 546/347; 548/335; 548/341; 548/203

[58] Field of Search ..... 204/49, 112; 106/1.27

[56] References Cited

U.S. PATENT DOCUMENTS 3,314,868 4/1967 Willmund et al. ..... 204/49

FOREIGN PATENT DOCUMENTS 1191652 4/1965 Fed. Rep. of Germany ..... 204/49

*Primary Examiner*—G. L. Kaplan

*Attorney, Agent, or Firm*—Keil & Witherspoon

[57] ABSTRACT

An acidic nickel electroplating bath containing brighteners and levelling agents, wherein the levelling agents are compounds of the formula I

I where ◯N is a hetero-aromatic nitrogen base, R, $R^1$ and $R^2$ are hydrogen or alkyl, $R^3$ is arylene, X is $SO_3^-$, Y is a neutralizing cation, n is from 1 to 3 and m is from 1 to 2.5.

2 Claims, No Drawings

ACIDIC NICKEL ELECTROPLATING BATH CONTAINING SULFOBETAINES AS BRIGHTENERS AND LEVELLING AGENTS

The present invention relates to a novel acidic nickel electroplating bath which in addition to conventional brighteners and wetting agents contains special heteroaromatic sulfobetaines as brighteners and levelling agents.

The use of reaction products of aromatic heterocyclic nitrogen bases with sultones as brighteners and levelling agents in nickel electroplating baths has been disclosed. According to their chemical structure, the compounds are inner salts of aminoalkanesulfonic acids (ie. sulfobetaines). One of the shortcomings ascribed to them is that they decompose easily under certain conditions, which detracts from the levelling effects and subsequently necessitates expensive regeneration of the electrolyte. A further fundamental shortcoming of this category of compounds is the poor levelling at low current densities.

Problems in the preparation and use of the compounds have arisen because of the fact that the sultone starting material, in particular propanesultone, is a strongly carcinogenic compound.

German Published Application DAS No. 1,191,652 describes a further group of brightener additives for acidic nickel electroplating baths. These are sulfobetaines of aromatic heterocyclic nitrogen bases, obtained, for example, by alkylating pyridine with dialkyl sulfates. The anion in these compounds is an alkylsulfate group.

This type of brightener again only produces satisfactory levelling at high current densities.

A further disadvantage of this category of compounds is that—as adequately documented in the literature—sulfuric acid half-esters hydrolyze easily even under slightly acidic conditions. It is true that the pyridinium compounds thereby produced also still act as brighteners and levelling agents, but at even very slight overdoses they lead to embrittlement and scorching at high current densities, so that once again expensive purification operations are necessary.

It is an object of the present invention to provide agents which do not produce these disadvantages and which in particular are also effective at low current densities.

We have found, surprisingly, that certain levelling agents and brighteners for weakly acidic nickel electrolytes are free from all these disadvantages and hence achieve the above objective.

The said levelling agents and brighteners have the formula I

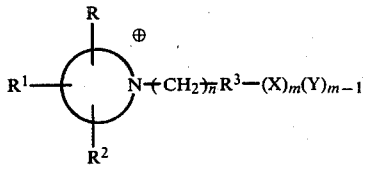

I where ◯N is a mononuclear or polynuclear heterocyclic-aromatic nitrogen base, R, $R^1$ and $R^2$ are hydrogen or $C_1$–$C_4$-alkyl, and may be identical or different from one another, $R^3$ is phenylene or thienylene, either of which is unsubstituted or substituted by chlorine, bromine, $C_1$–$C_4$-alkyl, methoxy or ethoxy, X is $SO_3\ominus$, Y is an alkali metal ion, ammonium ion or substituted ammonium ion or half of an alkaline earth metal cation or of a divalent transition metal cation, n is from 1 to 3 and m is from 1 to 2.5.

Nitrogen bases from which the brighteners are prepared have the formula II

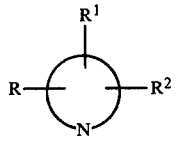

II where ◯N, R, $R^1$ and $R^2$ are defined as for formula I.

These nitrogen bases are mononuclear or polynuclear aromatic heterocyclic nitrogen bases, eg. pyridine, imidazole, thiazole, pyridazine, pyrazine, pyrimidine, quinoline, isoquinoline and also 1,2- and 1,3-benzdiazines, naphthiridines, pyridopyridines, triazines and acridines.

Examples of R, $R^1$ and $R^2$ are methyl, ethyl, n-propyl, isopropyl, n-butyl and isobutyl.

The preferred starting bases are pyridine, picoline, quinoline, pyrimidine and isoquinoline.

The nitrogen bases are first reacted with aralkyl halides of the formula III $$H—R^3—(CH_2)_nHal \qquad III$$

where $R^3$ and n are as defined in formula I of claim 1 and Hal is chlorine or bromine.

n is from 1 to 3 and $R^3$ is phenylene or thienylene, either of which may be unsubstituted or substituted by chlorine, bromine or $C_1$–$C_4$-alkyl, eg. methyl, ethyl, n-propyl and isopropyl. Accordingly, $—(CH_2)_n—$ can be methylene, ethylene or n-propylene.

Preferred compounds of the formula III are aralkyl halides, eg. benzyl chloride, phenylethyl chloride or phenylpropyl chloride, ie: $R^3$ is, in these cases, unsubstituted phenylene. The compounds mentioned are those most easily obtainable industrially, but substituted compounds are also suitable—as illustrated in the Examples.

The products resulting from the reaction of the compounds of the formulae II and III are heterocyclic ammonium salts of the formula IV

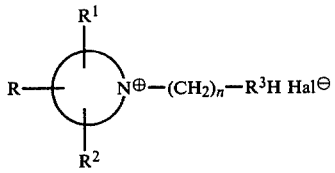

IV in which the symbols are as defined for formulae I to III. As the final stage, these compounds are sulfonated, for example with sulfur trioxide or chlorosulfonic acid.

The sulfonation is advantageously carried out in an aliphatic chlorohydrocarbon, eg. ethylene chloride, propylene chloride or the like.

Both the reaction steps, ie. the reaction of a nitrogen base with the aralkyl halide, and the sulfonation of the heterocyclic ammonium salt, are conventional operations familiar to those skilled in the art and therefore do not require special explanation; they are, furthermore, illustrated in the Examples.

In the sulfonation reaction, the sulfonating agent is in general employed in molar amounts, but the reaction can also be carried out with up to 2.5-molar (m=2.5), preferably up to 1.5-molar (m=1.5), amounts. If more than 1 mole of sulfonating agent is used, the excess sulfo groups, not counterbalanced by the positive charge of the nitrogen base, must be neutralized. In the latter case, the compounds contain neutralizing cations.

Suitable neutralizing cations are alkali metal ions and the equivalent amount (ie. half the amount) of alkaline earth metal ions or divalent transition metal ions, such as iron or nickel ions.

Unsubstituted or substituted ammonium ions also serve this purpose—examples include $NH_4^{\oplus}$, cyclohexylammonium, tributylammonium and others. The sodium, potassium and cyclohexylammonium cations are particularly preferred.

Compared to the sultone reaction products of the prior art, the compounds according to the invention have the advantage of being toxicologically safe to handle, both during synthesis and during use.

Benzylpyridinium chloride has, for example, been employed for a number of years as a levelling agent when dyeing anionically modified polyacrylonitrile fibers. The sulfobetaines thus obtained are more stable in a slightly acidic medium (ie. under the use conditions) than are the acid-sensitive sulfuric acid half-esters. Any decomposition products which may be formed by electrochemical degradation carry aromatic sulfonic acid groups and hence themselves act as secondary brighteners.

We have found that the new category of compounds comes closer than do conventional products based on pyridinium-sulfuric acid half-ester betaine or pyridinium-alkanesulfonate-betaine, to meeting a long-felt want of the electroplating industry, namely that good levelling agents should not only be effective at a high current density but should also give acceptable results at lower current densities and should hence also not have an excessive adverse effect on the macro-throwing power.

The baths contain the betaines of the invention in amounts of from 0.05 to 3 g/l of bath liquor, preferably from 0.1 to 0.5 g/l of bath liquor. In addition, they contain conventional primary and secondary brighteners, such as, respectively, acetylene-alcohols, acetyleneamines and oxyalkylated acetylene-alcohols, or sulfonamides, saccharin, vinylsulfonate, bis-benzenesulfonamide and the like, in amounts of, respectively, from 0.1 to 5 g/l or from 0.01 to 3 g/l. Furthermore, they contain conventional wetting agents in concentrations of from 0.1 to 1 g/l.

We have found that the novel betaines are entirely compatible with all these conventional additives. A very wide range of current densities can be employed, for example from 0.05 to 15 A/dm$^2$ at bath temperatures of from 40° to 80° C.

The Examples which follow illustrate the preparation and use of the novel sulfobetaines. In the Examples, parts are by weight.

EXAMPLE 1

381 parts of benzyl chloride are added dropwise to 237 parts of pyridine at 80°-90° C. After stirring for 1 hour at 90°-100° C., the product is dissolved in 2,600 parts of ethylene chloride. 720 parts of sulfur trioxide are added dropwise in the course of 60 minutes, this rate being such that the temperature does not rise above 40° C. The batch is then refluxed for 5 hours and cooled to 25° C., the ethylene chloride is separated off, the sulfonation mixture is dissolved in water and the last residues of ethylene chloride are steam-stripped. The mixture is neutralized with 444 parts of calcium hydroxide, 15 parts of active charcoal are added, the calcium sulfate and active charcoal are removed and the solution of the benzylpyridinium-sulfobetaine is concentrated to an active substance content of 50%.

EXAMPLE 2

Following the method described in Example 1, benzyl-2-picolinium chlorides are prepared and 658.5 parts thereof are introduced into 2,600 parts of ethylene chloride. The sulfonation and working up are carried out as described in Example 1.

EXAMPLE 3

Following the method described in Example 1, benzylmethylimidazolinium chlorides are prepared and 622.5 parts thereof are introduced into 2,600 parts of ethylene chloride. The sulfonation and working up are carried out as described in Example 1.

The compounds listed in the Table which follows were also prepared, in the form of 50% strength solutions, by the method described in Example 1 above.

TABLE

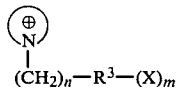

| Example | 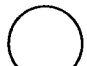 | $R^3$ | X | n | m |
|---|---|---|---|---|---|
| 4 | 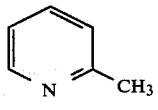 | 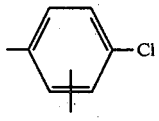 | $SO_3^-$ | 1 | 2 |

TABLE-continued
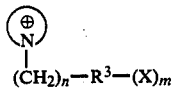
| Example | | $R^3$ | X | n | m |
|---|---|---|---|---|---|
| 5 | 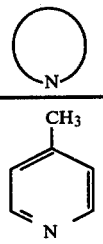 | 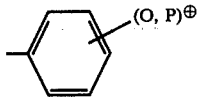 | $SO_3^-$ | 1 | 1 |
| 6 | 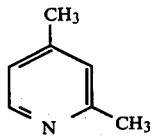 | 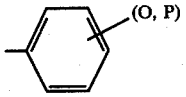 | $SO_3^-$ | 1 | 1 |
| 7 | 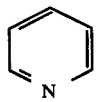 | 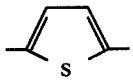 | $SO_3^-$ | 1 | 1 |
| 8 | 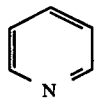 | 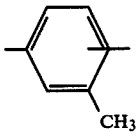 | $SO_3^-$ | 2 | 1,5⊕⊕ |
| 9 | 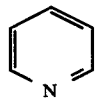 | 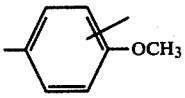 | $SO_3^-$ | 1 | 1 |
| 10 | 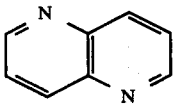 | 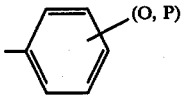 | $SO_3^-$ | 1 | 1 |
| 11 | 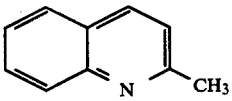 | 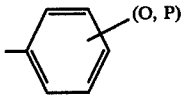 | $SO_3^-$ | 1 | 1 |
| 12 | 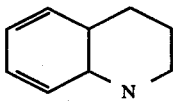 | 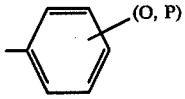 | $SO_3^-$ | 1 | 1 |
| 13 | 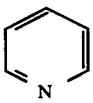 | 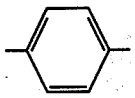 | $SO_3^-$ | 1 | 1 |
| 14 | 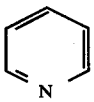 | 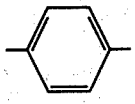 | $SO_3^-$ | 2 | 2 |
| 15 | 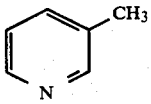 | 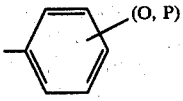 | $SO_3^-$ | 1 | 1 |
| 16 | 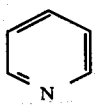 | 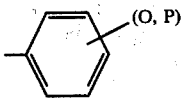 | $SO_3^-$ | 3 | 1 |

TABLE-continued

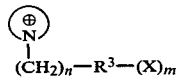

| Example | | $R^3$ | X | n | m |
|---|---|---|---|---|---|
| 17 | 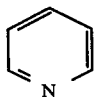 | 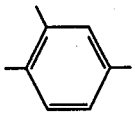 | $SO_3^-$ | 3 | 2 |
| 18 | 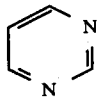 | 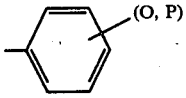 (O, P) | $SO_3^-$ | 1 | 1 |
| 19 | 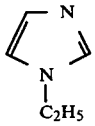 | 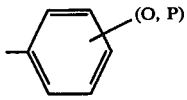 (O, P) | $SO_3^-$ | 1 | 1 |
| 20 | 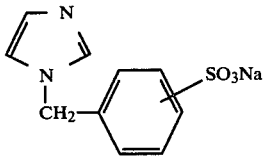 | 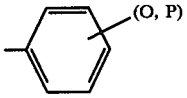 (O, P) | $SO_3^-$ | 1 | 1 |
| 21 | 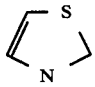 | 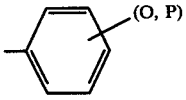 (O, P) | $SO_3^-$ | 1 | 1 |
| 22 | 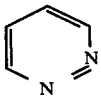 | 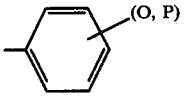 (O, P) | $SO_3^-$ | 1 | 1 |
| 23 | 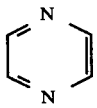 | 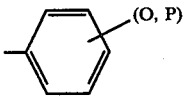 (O, P) | $SO_3^-$ | 1 | 1 |
| 24 | 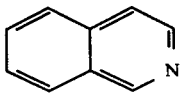 | 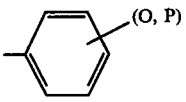 (O, P) | $SO_3^-$ | 1 | 1 |

⊕Mixture of ortho-compound and para-compound
⊕⊕Statistical mean value

The compounds specified in the preceding Examples were tested for their suitability as brighteners and levelling agents.

The tests were carried out in a 250 ml Hull cell at 50°–55° C., nickel being deposited for 10 minutes at a current of 2.2 A through the cell onto non-polished brass-plated iron sheets. The metal coating was assessed over the entire current density range, but in particular the levelling (disappearance of the rolling marks of the base sheet) in the low current density range was examined.

EXAMPLE 25

An electrolyte of the following composition was tested by the process described above.

Watt's electrolyte:

2 g/l of saccharin
0.8 g/l of Na vinylsulfonate
0.5 g/l of a sulfated adduct of dodecyl alcohol and 10 moles of ethylene oxide
0.5 g/l of benzylpyridinium-sulfobetaine (according to Example 1).

Over the current density range of 0.5–11 A/dm$^2$, a glossy, ductile and very well-levelled nickel coating was obtained. In the low current density range of <0.5 A/dm$^2$, slight rolling marks of the base sheet were discernible.

EXAMPLE 26

Instead of the benzylpyridinium-sulfobetaine in Example 25, benzyl-2-picolinium-sulfobetaine, obtained as described in Example 2, was employed as the brightener and levelling agent.

Glossy, ductile and very well-levelled nickel coatings were obtained at current densities of from 0.8 to 11 A/dm$^2$.

In the low current density range of <0.8 A/dm$^2$, the rolling marks of the base sheet were visible.

EXAMPLE 27

Instead of the compounds to be used according to the invention, prior art products, namely pyridinium-propanesulfonate and pyridinium-(hydroxyethyl-2-sulfate), according to German Published Application DAS No. 1,191,652, were employed as levelling agents and brighteners.

These compounds again gave entirely acceptable levelling and brightness of the nickel coatings in the high and medium current density ranges. However, the rolling marks of the base sheets were in this case clearly discernible at current densities of up to 1.5–2 A/dm$^2$, which indicates poorer levelling in the low current density range and, quite generally, lower macro-throwing power of the electrolytes when using these levelling agents and brighteners as compared to the products according to the invention.

EXAMPLE 28

Instead of benzylpyridinium-sulfobetaine according to Example 25, benzyl-4-picolinium-sulfobetaine (Example 5) was employed.

The results were of comparable quality to those of Example 26.

EXAMPLE 29

Using the method described above, an electrolyte of different basic composition was tested. Watt's electrolyte 3 g/l of saccharin
0.15 g/l of butyne-1,4-diol
0.5 g/l of Na 2-ethylhexyl-sulfate
0.4 g/l of benzyl-cyclohexylammonium-sulfobetaine (according to Examples 1 and 12) levelling agent according to the invention.

Under these coating conditions, very bright, ductile and very well-levelled nickel coatings were obtained over the entire current density range of 0.5–11 A/dm$^2$.

In contrast to the prior art pyridinium-propanesulfonate or pyridinium-(hydroxyethyl-2-sulfate), where rolling marks are distinctly discernible at current densities of up to 1 A/dm$^2$, the novel compounds give coatings free from such marks at current densities down to 0.5 A/dm$^2$.

EXAMPLE 30

Using the method described above, an electrolyte of the following composition was tested: Watt's electrolyte:

2 g/l of bis-benzenesulfonimide
3 g/l of Na allylsulfonate
0.5 g/l of alkyl-polyglycol-ether-sulfate (according to Example 25)
0.4 g/l of benzylpyridinium-sulfobetaine (according to Example 1)

Very bright, very well-levelled, ductile nickel coatings were obtained in the current density range of 0.5–11 A/dm$^2$.

EXAMPLE 31

Benzyl-2-picolinium-sulfobetaine, benzyl-4-picolinium-sulfobetaine and benzyl-3-picolinium-sulfobetaine (according to Examples 2, 5 and 15) were examined as levelling agents and brighteners by the method of Example 30. Very bright, well-levelled, ductile nickel coatings were obtained in the current density range of 1–11 A/dm$^2$.

EXAMPLE 32

Using the method described above, an electrolyte of the following composition was tested. Watt's electrolyte:

3 g/l of saccharin
0.2 g/l of butyne-1,4-diol
0.02 g/l of an adduct of butyne-1,4-diol with 1 mole of ethylene oxide
0.5 g/l of Na 2-ethylhexyl-sulfate
0.4 g/l of benzylpyridinium-sulfobetaine (according to Example 1)

Very bright, very well-levelled, ductile nickel coatings were obtained in the current density range of 0.1–11 A/dm$^2$.

EXAMPLE 33

Using the method described above, an electrolyte of the following composition was tested: Watt's electrolyte:

2 g/l of saccharin
3 g/l of Na allylsulfonate
0.15 g/l of butyne-1,4-diol
0.01 g/l of diethylamino-propyne
0.5 g/l of Na 2-ethylhexyl-sulfate
0.4 g/l of benzylpyridinium-sulfobetaine (according to Example 1)

Very bright, very well-levelled, ductile nickel coatings were obtained in the current density range of 1–11 A/dm$^2$.

EXAMPLE 34

Using the method described above, an electrolyte of the following composition was tested: Watt's electrolyte:

2 g/l of saccharin
0.25 g/l of an adduct of butynediol with 1 mole of propylene oxide
0.5 g/l of Na nonanol-sulfate
0.4 g/l of benzylpyridinium-sulfobetaine (according to Example 1)

Very bright, very well-levelled, ductile nickel coatings were obtained in the current density range of 0.5–11 A/dm$^2$.

We claim:

1. An acidic nickel electroplating bath of conventional composition, containing brighteners and levelling agents, wherein the said brighteners and levelling agents comprise one or more compounds of the formula I

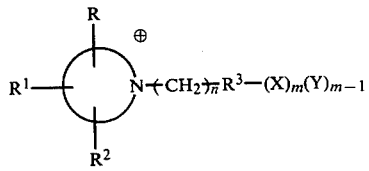

I where ◯N is a mononuclear or polynuclear heterocyclic-aromatic nitrogen base, R, $R^1$ and $R^2$ are hydrogen or $C_1$–$C_4$-alkyl, and may be identical or different from one another, $R^3$ is phenylene or thienylene, either of which is unsubstituted or substituted by chlorine, bromine, $C_1$–$C_4$-alkyl, methoxy or ethoxy, X is $SO_3^{\ominus}$, Y is an alkali metal ion, ammonium ion or substituted ammonium ion or half of an alkaline earth metal cation or of a divalent transition metal cation, n is from 1 to 3 and m is from 1 to 2.5.

2. An acidic nickel electroplating bath which contains, as brighteners and levelling agents, one or more compounds of the formula I according to claim 1, where ◯N is pyridine, imidazole, thiazole, pyridazine, pyrazine, pyrimidine, quinoline, isoquinoline, 1,2- or 1,3-benzdiazine, a naphthiridine, a pyridopyridine, a triazine or an acridine.

* * * * *